US005197761A

United States Patent [19]

Shirdavani

[11] Patent Number: 5,197,761

[45] Date of Patent: Mar. 30, 1993

[54] BOOK PULLER AND METHOD OF MAKING SAME

[76] Inventor: Hossain A. Shirdavani, 14425 NE. 37th Pl., Bellevue, Wash. 98007

[21] Appl. No.: 683,992

[22] Filed: Apr. 11, 1991

Related U.S. Application Data

[63] Continuation-in-part of Ser. No. 542,881, Jun. 25, 1990, abandoned, which is a continuation-in-part of Ser. No. 419,468, Oct. 10, 1989, abandoned, which is a continuation-in-part of Ser. No. 342,022, Apr. 24, 1989, abandoned.

[51] Int. Cl.[5] ..... B42D 3/00

[52] U.S. Cl. ..... 281/15.1; 281/32; 281/51

[58] Field of Search ..... 281/15, 43, 32, 29, 281/36, 51; 229/117.23, 117.09

[56] References Cited

U.S. PATENT DOCUMENTS

| | | | |
|---|---|---|---|
| 106,234 | 8/1870 | Terry . | |
| 753,585 | 3/1904 | Koch . | |
| 829,988 | 9/1906 | Moll . | |
| 870,958 | 11/1907 | Hinckley . | |
| 1,130,893 | 3/1915 | Duval . | |
| 1,760,574 | 5/1930 | Wright . | |
| 1,893,999 | 1/1933 | Masse . | |
| 2,021,787 | 11/1935 | Janowitz | 229/52 |
| 2,465,616 | 3/1949 | Sziklai | 281/32 |
| 3,828,454 | 8/1974 | Hafner et al. | 40/27 |
| 4,679,823 | 7/1987 | Nagy | 281/43 |

*Primary Examiner*—Mark Rosenbaum
*Assistant Examiner*—Willmon Fridie, Jr.
*Attorney, Agent, or Firm*—Robert W. Jenny

[57] ABSTRACT

A book puller (10) has a main body (23) with generally square end portions (13, 14) and a center portion (12) having concavely curved outer edges (68). The center portion (12) has a reinforcing layer (24). The end portions (13, 14) are attached to the front and back covers of a book by pressure sensitive adhesive, with the junctures (19, 20) between the center portion (12) and the end portions (13, 14) positioned at the spine edges (21, 22) of the book. The center portion (12) loops around the spine (66) of the book and is spaced therefrom to form a handle (38). Pulling forces exerted on the handle (38) by inserting a finger behind it are distributed by the concave edges (68) to the end portions (13, 14). The pullers (10) may be manufactured by separating a roll of body forming material from its backing material, inserting a strip of reinforcing material therebetween, pulling the three layers through pressure rollers, and die cutting the pullers (10). An alternative method involves cutting body forming material and its backing material into strips, removing the center portion of each strip of backing material and replacing it with reinforcing material, and die cutting the strips.

3 Claims, 4 Drawing Sheets

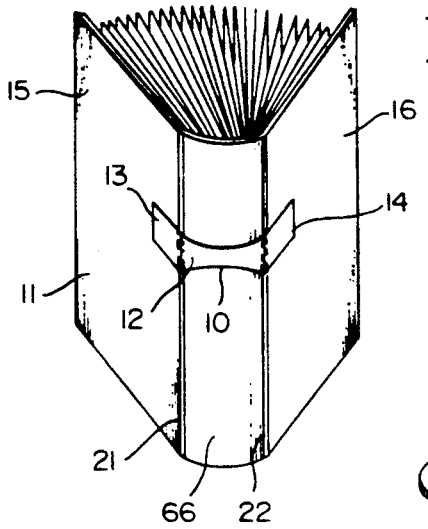
FIG. 1
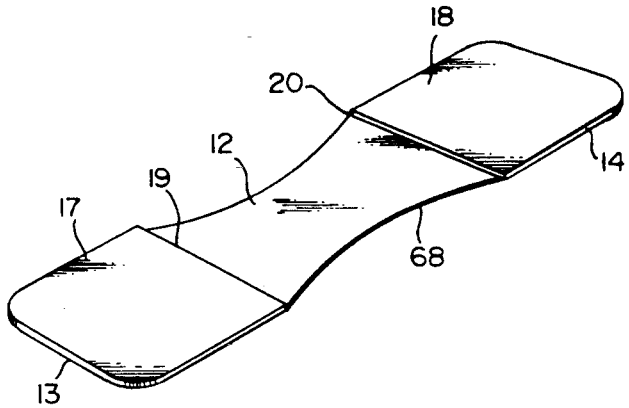
FIG. 2
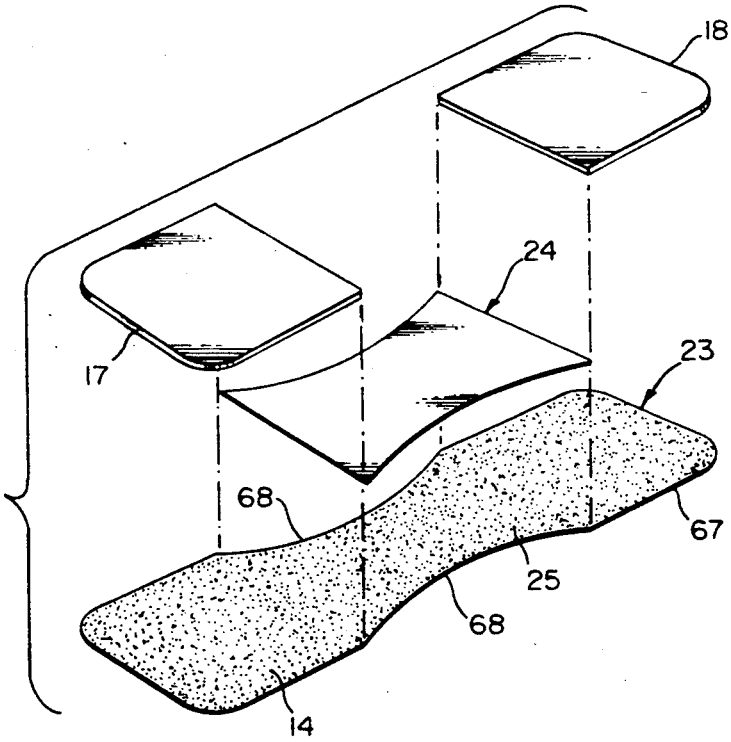
FIG. 3
FIG. 4
PRIOR ART
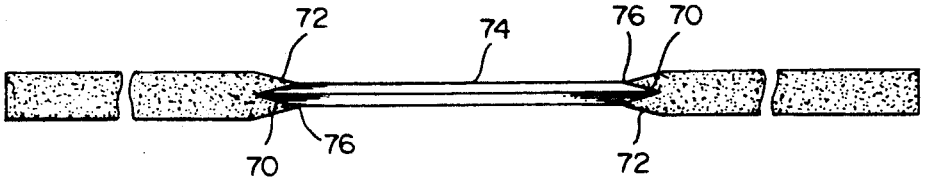

FIG. 7
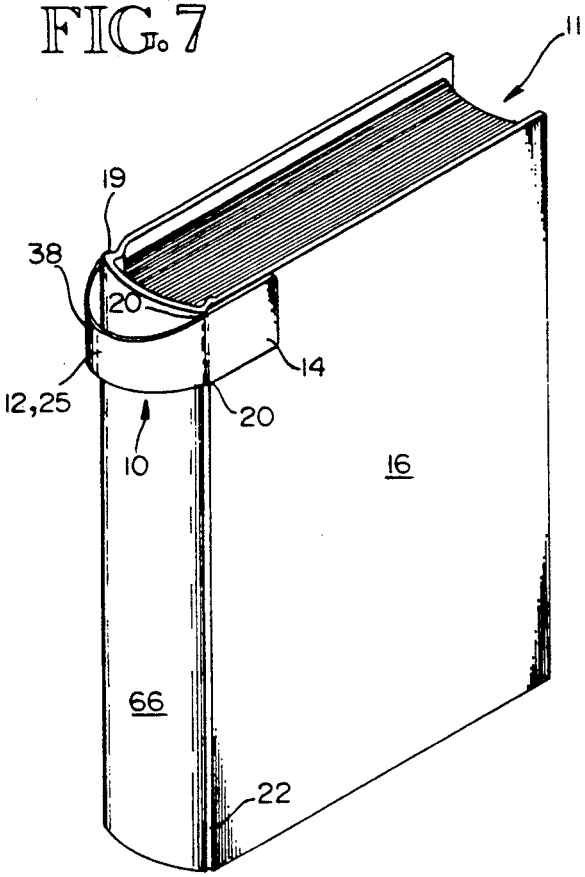
FIG. 8
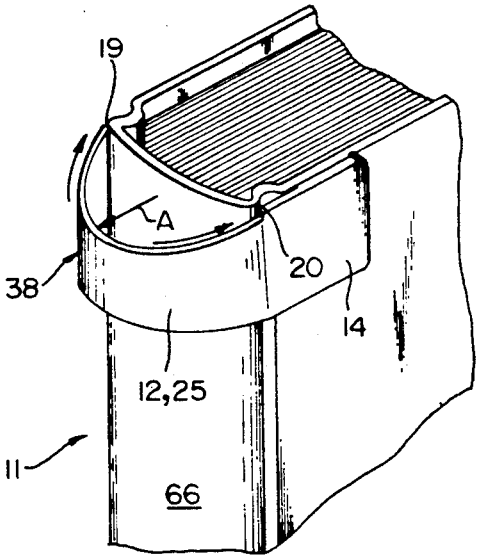
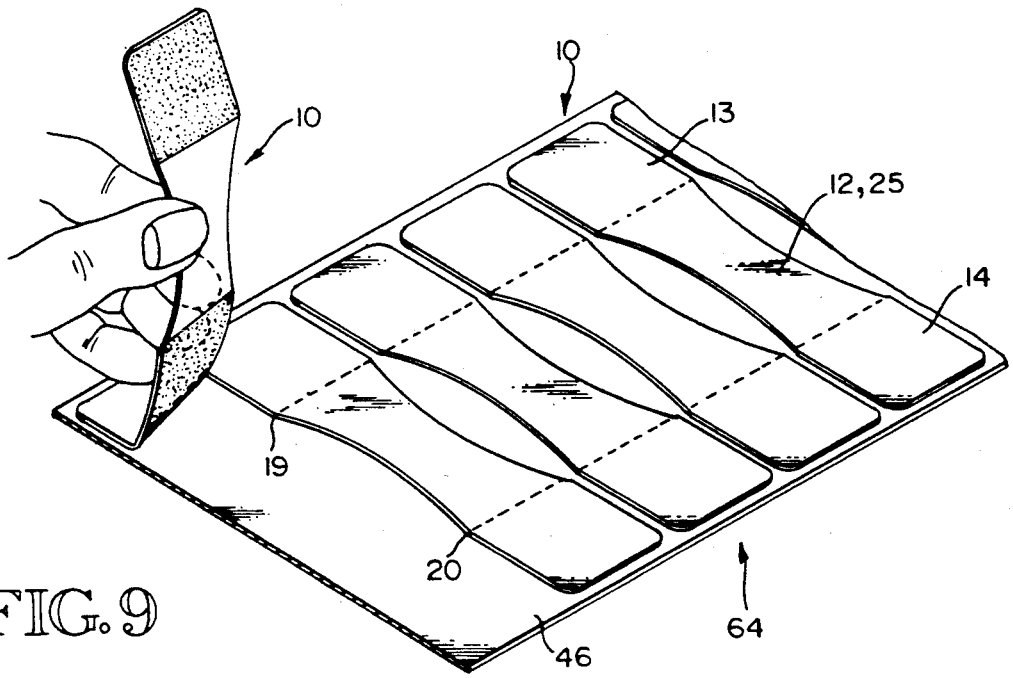
FIG. 9

BOOK PULLER AND METHOD OF MAKING SAME

RELATED APPLICATIONS

This application is a continuation-in-part of application Ser. No. 542,881, filed Jun. 25, 1990, now abandoned which was a continuation-in-part of Ser. No. 419,468, filed Oct. 10, 1989, now abandoned and which was a continuation-in-part of application Ser. No. 342,022, filed Apr. 24, 1989, now abandoned.

TECHNICAL FIELD

The subject invention relates to pullers for use on books to facilitate removal of books from storage shelves, and to a method of making such book pullers.

BACKGROUND INFORMATION

There has been a long standing need for means to alleviate or prevent the damage often found on books which are frequently removed from and replaced in a storage space on a shelf. The damage most often observed occurs at the top of the spine (the back of the binding) of such books and is caused by repeated removal of a book by hooking the tip or tips of fingers over the top of the spine to pull the book from its storage place.

U.S. Pat. No. 4,679,823 discloses an identification handle for use on accordion file pockets. The handle is rectangular with straight edges. The ends of the handle are adhesively attached to the front and back walls of a file pocket, and the unattached intermediate portion of the handle extends around the expandable side gusset of the pocket. The edges and outside face of the handle have no visible or tangible indication of how much of each end of the handle should be fastened to the file pocket. If not enough of either or both end portions is fastened, the fastening will be too weak. If too much is fastened, not enough clearance will be allowed between the handle and the side of the file pocket. Also, in the embodiment of FIGS. 5 and 6, the free, loop portion, which is subject to the tendency to tear under use conditions, is only a single thickness. In the embodiment of FIGS. 2–4, part of the loop portion has a double thickness created by folding tabs against the back, but the reinforcing layer is not continuous and the main layer is interrupted by a window.

U.S. Pat. No. 2,021,787 discloses a carrying handle for parcels which, if made in the appropriate size and proportions, could serve as a book puller and has a double thickness center portion. However, the total cross-sectional area of the center portion is not increased because the double thickness is provided by folding the edges of the material over on itself in the center portion. Moreover, the reinforcing layer is not continuous, but rather is split longitudinally down the middle. No actual reinforcement is achieved and the process of cutting and folding the center portion will add more to the cost of the item than simply adding a layer of material to the center portion. The ends of the cuts needed to allow folding over the edges of the center portion will produce stress raising points at the end of each cut which increases the chances of the material tearing under use loads. Further, and most important, the cross-sectional areas effective at the cuts is only one half that of the basic handle.

Other prior art U.S. patents to be considered are U.S. Pat. Nos. 106,234; 753,585; 829,988; 870,958; 1,130,893, 1,760,574; 1,593,999; 2,465,616; and 3,828,454. The last listed patent discloses a tag with reinforcing patches.

SUMMARY OF THE INVENTION

A subject of the invention is a book puller that comprises a flexible planar main body and a separate flexible planar reinforcing layer. The main body has an elongated inner face coated with a pressure sensitive adhesive and a coextensive opposite outer face. The inner face has opposite end portions and a center portion extending between and connecting the end portions. The body has an essentially smooth continuous outer edge extending around and defining the end portions and the center portion. The outer edge has opposite sides, each of which includes a straight portion along each of the end portions and a concavely curved portion along the center portion joining the straight portions at respective junctures. The junctures are visually and tactilely perceptible. The reinforcing layer is coextensive with and adhered to the center portion of the inner face of the main body. The center portion is dimensioned to form, when the end portions are adhered to front and back surfaces of a book, respectively, with the junctures positioned at opposite spine edges of the book, an arcuate handle extending around the book between the junctures. The handle is spaced from the book a distance sufficient to allow insertion of a finger between the book and the handle.

The structure of the book puller of the invention results in a strong, reliable, and economical puller that is durable and easy to apply and use. The puller is easily attachable to a variety of types of books and does not significantly increase storage space requirements. The combination of the visually and tactilely perceptible junctures, the continuous outer edge, and the concavely curved center portion has a number of advantages. Since the junctures can be perceived visually and/or tactilely, the correct positioning of the puller on a book with the junctures at the spine edges of the book can be readily accomplished. Once the puller has been installed on a book, the concave curve along the center portion of the continuous edge evenly spreads the pulling force to the end portions attached to the book when a finger is inserted behind the puller to pull the book from a shelf. The reinforcement of the center portion of the puller is accomplished without sacrificing the integrity of the continuous outer edge of the body and the maintenance of the even distribution of pulling forces. In addition, the concavity of the center curved portion helps to guide a pulling finger to the true center of the puller to enhance the even distribution of forces. The distribution of forces in turn helps maintain the puller correctly in position on the book and ensure smooth pulling action of the book from a shelf.

Another subject of the invention is a method of manufacturing book pullers. According to an aspect of the invention, the method comprises providing a roll of flexible sheet material. The material includes a layer of puller forming material having an inner face coated with a pressure sensitive adhesive, and a layer of backing material releasably adhered to the face. The roll has a first width. The sheet material is pulled from the roll. The layers are separated from each other by bending one of the layers around a roller. The layers are pulled separately along diverging pathways. A second roll of flexible sheet material is provided. It comprises a reinforcing material and has a second width less than the first width. The second roll is positioned between the layers downstream of the roller. The reinforcing material is pulled from the second roll toward a pair of pressure rollers. Simultaneously, the layers are pulled along converging pathways toward the pressure rollers. The layers and the reinforcing material are pulled between the pressure rollers to adhere the reinforcing material to a center portion of the inner face of the puller forming material and re-adhere the backing material to opposite edge portions of the face on opposite sides of the center portion. The readhered layer of puller forming material and the reinforcing material are die out to form separate book pullers extending widthwise across the backing material. Each puller extends across the center portion and at least partially across each edge portion of the face.

A puller made in accordance with the method described above is also a subject of the invention. The method has the advantages of being relatively simple to carry out and of being capable of efficiently producing strips of backing material having several pullers positioned thereon for easy packaging of the pullers. When the strips reach the final user, each puller may be easily and quickly removed from the strip of backing material and applied to a book.

The invention also encompasses an alternative method of making the puller. This method comprises the steps of:

1. Providing a roll of raw material including puller forming material and backing material.
2. Slitting the raw material into strips in a range of widths, the range of widths corresponding to the range of lengths of pullers.
3. Stripping the backing material from the center portions of the strips.
4. Providing a strip of plastic.
5. Replacing the stripped backing material with the strip of plastic.
6. Die cutting the pullers from the strips, each puller being cut such that its length is transverse to the length of the strip, whereby each puller has backing material on each of its end portions and a reinforced center portion.

The advantages and features described above and other advantages and features will become apparent from the detailed description of the best modes for carrying out the invention that follows.

BRIEF DESCRIPTION OF THE DRAWINGS

In the drawings, like element designations refer to like parts throughout, and

FIG. 1 is a pictorial view of the preferred embodiment of the puller attached to a book.

FIG. 2 is a pictorial view of the puller shown in FIG. 1 having a first arrangement of backing material.

FIG. 3 is an exploded pictorial view of the puller shown in FIG. 2.

FIG. 4 is an elevational view of the rear face of a prior art handle.

FIG. 7 is a pictorial view of the preferred embodiment of the puller attached to a book.

FIG. 8 is an enlarged fragmentary pictorial view of the installed puller shown in FIG. 7, illustrating the distribution of pulling forces from the center portion to the end portions of the puller.

FIG. 9 is a pictorial view of a strip of backing material with a plurality of pullers positioned thereon, illustrating the removal of a puller from the strip.

BEST MODES FOR CARRYING OUT THE INVENTION

Figure 5:
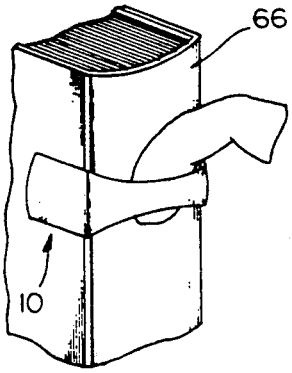
FIG. 5 is a fragmentary pictorial view illustrating the use of the book pullers of the invention.

The drawings show a puller 10 that is constructed according to the invention and that constitutes the best mode of the apparatus of the invention currently known to the applicant. The drawings also illustrate two methods of making the puller 10 which constitute the best modes of the method of the invention currently known to the applicant. The puller of the invention is for attachment to books to enable the removal of the books from storage repeatedly without damage to the books by repeated contacts. The puller may be provided in a range of lengths, with each length being suitable for use on books in a range of thicknesses.

The preferred embodiment of the puller 10 is shown attached to a book 11 in FIG. 1. The puller 10 comprises a center portion 12, and end portions 13 and 14. The end portions are attached by pressure sensitive adhesive to back cover 15 and front cover 16 of the book 11. The puller 10 is shown in more detail in FIG. 2, in which end portions 13 and 14 are covered by protective cover pieces 17 and 18. The center portion 12 is contoured so that its junctures 19 and 20 with the end portions 13, 14 are discernible by sight and touch. Specifically, the contour in plan view of the puller 10 is preferably such that its edges are indented in the center portion 12 between the end portions 13, 14 so that the junctures 19, 20 between the center portion 12 and the end portions 13, 14 are made discernible by both sight and touch by the changes in contour of the edges of the puller 10 at the junctures 19, 20. In the preferred embodiment shown in the drawings, the center portions are concavely curved in circular arcs with a large radius of curvature.

The puller 10 comprises a flexible planar main body 23 and a separate flexible planar reinforcing layer 24. The individual shapes of these two elements can most clearly be seen in the exploded view of FIG. 3. FIGS. 2 and 3 also show separate protective cover pieces 17, 18 of backing material for the exposed adhesive inner faces of the end portions 13, 14 of the puller 10. These separate cover pieces 17, 18 result from the method of manufacture illustrated in FIG. 6 and described below. When the pullers 10 are manufactured by the preferred procedure illustrated in FIGS. 10–12, the separate protective cover pieces 17, 18 are replaced by a strip 64 of backing material 46, as illustrated in FIG. 9. The latter arrangement of a plurality of pullers 10 carried by a strip 64 of backing material 46 has the advantage of allowing convenient packaging of the pullers 10 and expedited removal of an individual puller 10 from the strip 64, as illustrated in FIG. 9.

The main body 23 of the puller 10 has an elongated inner face that is coated with a pressure sensitive adhesive 44, and a smooth coextensive opposite outer face.

In the assembled puller 10, the reinforcing layer 24 covers the adhesive 44 on the center portion 25 of the main body 23. The reinforcing layer 24 reinforces the center portion 25 by essentially doubling its cross-sectional area.

The inner face of the main body 23 of the puller 10 has opposite end portions 13, 14 between which the center portion 25 extends and which are connected by the center portion 25. The body 23 has an essentially smooth continuous outer edge that extends around and defines the end portions 13, 14 and center portion 25 of the body 23. The outer edge has opposite sides, each of which includes a straight portion 67 along each of the end portions 13, 14 of the puller 10, and a concavely curved portion 68 along the center portion 25 of the body 23. The concavely curved portion 68 joins the straight portions 67 at the junctures 19, 20. There is a change in curvature at each juncture 19, 20 which is visually and tactilely perceptible, but the outer edge is not interrupted at the juncture 19, 20 and remains essentially smooth at the juncture 19, 20.

The reinforcing layer 24 is coextensive with and adhered to the center portion 25 of the inner face of the main body 23. The center portion 23 and reinforcing layer 24 are dimensioned to form an arcuate handle 38 (FIGS. 7 and 8) when the end portions 13, 14 are adhered to the front and back covers 16, 15 of a book 11 with the puller junctures 19, 20 positioned at opposite spine edges 21, 22 of the book 1. The handle 38 extends around the book 11 between the junctures 19, 20. The handle 38 is spaced from the spine 66 of the book 11 a distance sufficient to allow the insertion of at least one finger between the book spine 66 and the handle 38.

Each puller 10 is substantially rectangular in shape with rounded corners. The width of the rectangle is approximately one inch. The length is such that the end portions of the puller 10 can be attached, by the pressure sensitive adhesive 44 on the inner face, to the front and back covers 16, 15 of a book 11. The center portion of the attached puller 10 (the handle 38) is preferably loose enough across the spine 66 of the book 11 to allow insertion of thumb and forefinger or two fingers between the puller 10 and the spine 66 of the book 11 to pull the book 11. As shown in FIGS. 2 and 3, the end portions 13, 14 of the puller 10 are covered by protective cover pieces 17, 18 until the puller 10 is used. The protective cover (backing material) has been removed from the center portion 25 and replaced by the reinforcing layer 24. The layer 24 may be a film of plastic, transparent or colored. This film 24 increases the cross-sectional area of and reinforces the center portion 25 of the main body 23 of the puller 10 and covers the adhesive exposed by the removal of the protective cover from the center portion. The raw material from which the puller is made is preferably a commercially available roll of Mylar (trademark), coated on one side with pressure sensitive adhesive with the adhesive protected until use by a disposable cover layer of backing material. All the corners of the pullers 10 are preferably radiused since it has been found by experience that radiusing the corners significantly decreases the chances of peeling of the pullers 10 off books by rubbing contacts between the pullers 10 and adjacent books and other surfaces and objects.

To attach the puller 10, as shown in FIG. 2, to a book 11, the protective cover piece 17, 18 is removed from one end portion and that end portion is pressed onto either the front or back cover 16, 15 of the book 11 with the juncture 19, 20 of that end portion and the center portion 12 aligned with the juncture of the front or back cover with the back of the book (the spine edge 21, 22). The protective cover piece 17, 18 is then removed from the other end portion of the puller 10 and that end portion is pressed onto the other cover 15, 16 of the book 11 with its juncture 19, 20 with the center portion also aligned with the juncture of the back of the book and the cover. In the case of a puller 10 carried on a strip 64 of backing material 46, as shown in FIG. 9, the puller 10 is removed from the backing material 46 first and then applied to the book 11 as described above. In either case, the puller 10 may be attached anywhere from top to bottom of the spine of a book, positioning near the bottom being preferred for books stored on overhead shelves.

As noted above, the structure of the puller of the invention, with its continuous outer edge and concavely curved center portion, serves to evenly distribute pulling forces to the end portions of the puller. FIG. 5 illustrates the insertion of a finger between the spine 66 of a book and the puller 10 to pull on the center portion of the puller 10 and thereby remove the book from a shelf or other storage space. FIG. 8 illustrates the forces on the puller 10. Arrow A illustrates the pulling force on the center portion 12 of the puller 10 exerted by a finger or fingers inserted between the center portion 12 and the spine 66 of a book 11. The arrows extending around the center portion 12 toward the end portions 13, 14 of the puller 10 show the distribution of the pulling force. The concavely curved outer edge of the center portion 12 directs the pulling forces along such curved edge to the outer edges of the end portions 13, 14. This action of the curved edges to direct the pulling force to the edges of the end portions 13, 14 distributes the pulling force evenly along the entire vertical width of the end portions 13, 14 to maximize their effectiveness in reacting the forces. Since the edges are continuous, there are no points along the edges that are vulnerable to tearing as a result of the pulling force. The integrity of the structure of the puller 10 remains intact after repeated uses for removing the book 11 from a storage area.

For the purposes of comparison, FIG. 4 is a reproduction of FIG. 4 of U.S. Pat. No. 2,021,787, cited above. Although the handle illustrated in FIG. 4 bears a superficial similarity to the puller of the invention, the proportions are not the same and, more importantly, the structural characteristics are very different. Rather than being continuous, the outer edge of the handle shown in FIG. 4 is interrupted by diagonal cuts which terminate at points 76. The center portion of the handle between the ends 76 of the outs is folded over on itself to form a reduced width double thickness center portion 74. The pointed ends 70 of the folded over portions extend beyond the inner cuts ends 76 and are coextensive with the pointed ends 72 of the unfolded portion of the handle. The inner ends 76 of the cuts are separated across the handle by a width that is only half of the full width of the unfolded handle. The cut ends 76 form weak points that make the handle vulnerable to tearing when a pulling force is exerted on the center portion 74. Moreover, rather than providing a means for distributing the pulling force to the full width of the ends of the handle, the pointed ends 70 of the folded portion converge to the widthwise center of the handle.

A puller could be made with adhesive applied only to the end portions. However, material with adhesive applied to specific areas only would require special manufacture for all lengths of the pullers and be significantly more expensive than using commercially available raw material covered entirely on one side with the adhesive. Also, the thickness of the center section could be doubled by folding edges of the material over on itself as shown in FIG. 4. However, the cross-sectional area is not increased and the ends of the cuts needed to fold the edges are susceptible to tearing under use loads. It has been shown by testing and experience that pullers of this kind fail structurally at points near the centers of the pullers, usually in the form of tears starting at the upper edge and, once started, progressing rapidly across the material. It is this type of tearing which occurs readily at the cuts referred to above with reference to U.S. Pat. No. 2,021,787. In the puller of the invention, the center portion is reinforced without losing the advantage of the reinforcement by increasing chances of failure of the puller elsewhere.

The principles involved can be readily demonstrated using puller models made from commercially available, ¾" wide masking tape. With load applied as shown in FIG. 5, i.e. at the top edge of the loop formed by the puller, unreinforced tape fails under the finger. Tape reinforced by another layer of tape fails wherever the reinforcement ends. If the basic piece of tape is cut near to and beyond the end of the reinforcement, the puller fails readily at the cut(s) because the cuts are stress raisers and the cross-sectional areas of the straps between the ends of the cuts are only half the basic cross-sectional areas of the straps.

Figure 10:
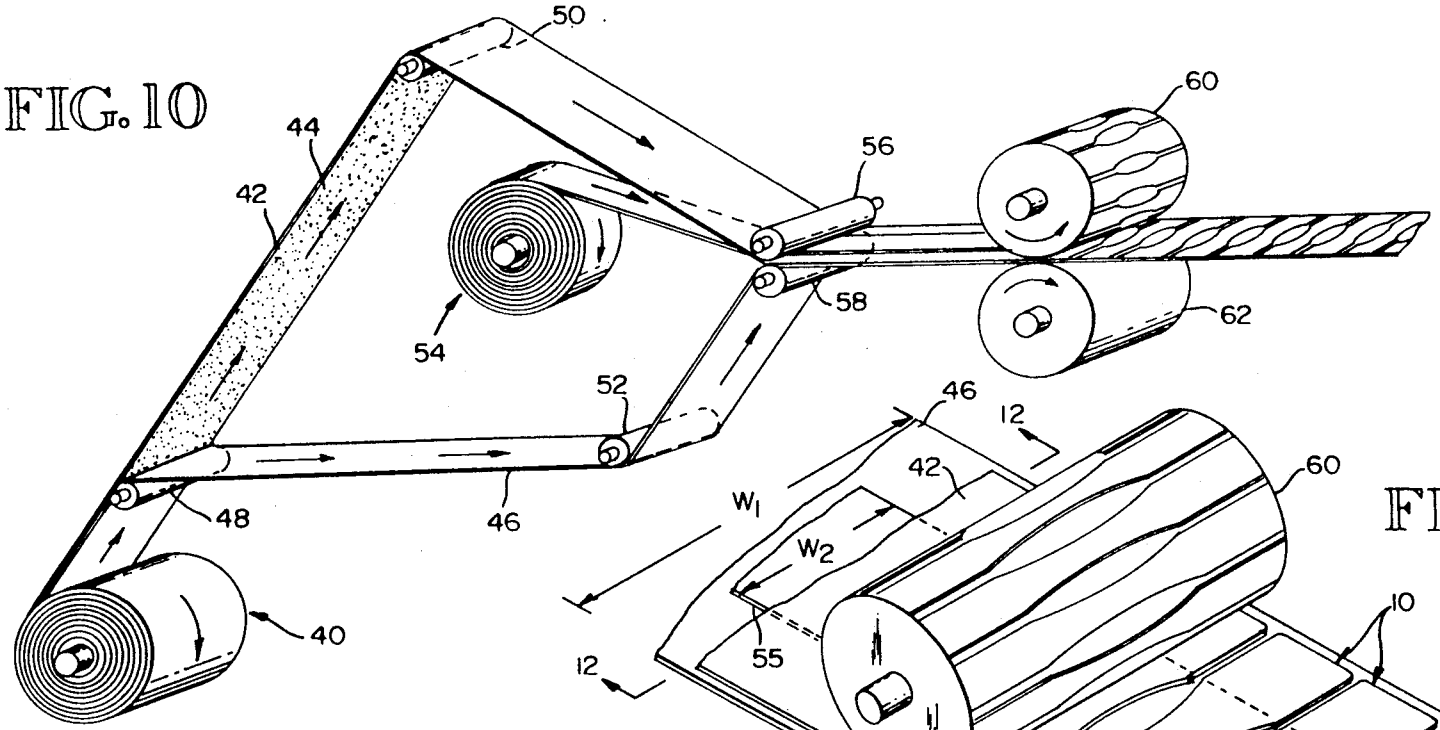
FIG. 10 is a partially schematic pictorial view of the preferred embodiment of making the puller of the invention.
Figure 11:
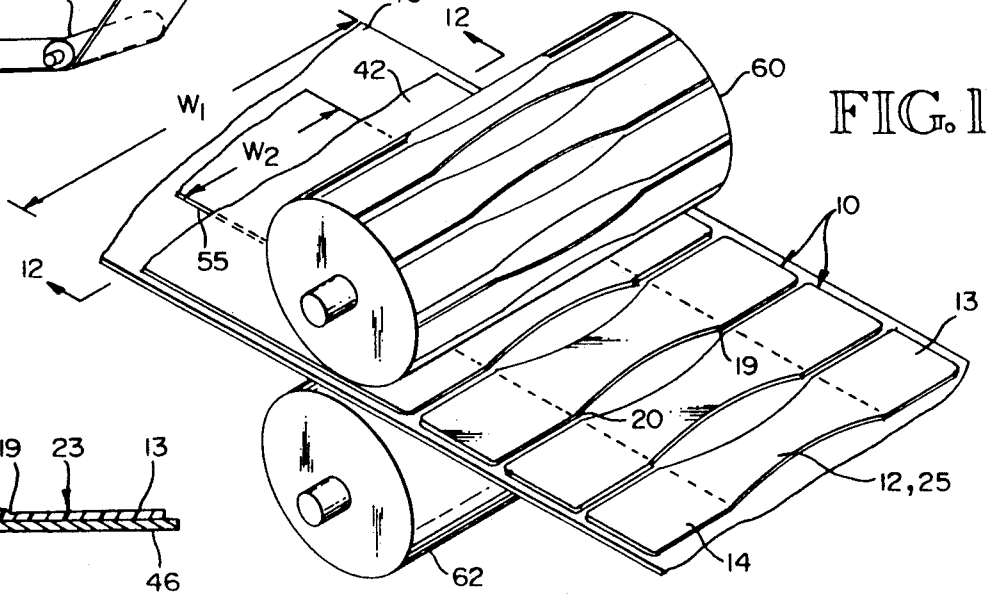
FIG. 11 is an enlarged pictorial view of the die cutting portion of the apparatus shown in FIG. 10.
Figure 12:
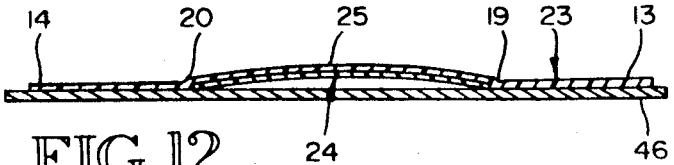
FIG. 12 is a sectional view taken along line 12—12 in FIG. 11.

The invention also encompasses the manufacture of book pullers. The currently most preferred method of making the book puller 10 is illustrated in FIGS. 10–12. The method begins with the provision of a roll 40 of flexible sheet material including a layer of puller forming material 42, such as Mylar (trademark), and a layer of backing material 46. The inner face of the puller forming material 42 is coated with a pressure sensitive adhesive 44. The backing material 46 is releasably adhered to the face by the adhesive 44. The roll 40 and both of its layers 42, 46 have a first width W Referring to FIG. 10, the sheet material is pulled from the roll 40, and the layers 42, 46 are separated from each other by bending one of the layers 42, 46 around a roller 48. As shown in FIG. 10, the backing material 46 is bent around the roller 48. Downstream of the roller 48, the layers 42, 46 are pulled separately along diverging pathways. These diverging pathways end at guide rollers 50, 52, respectively. A second roll 54 of flexible sheet material comprising reinforcing material is positioned between the diverged layers 42, 46 in the vicinity of the guide rollers 50, 52. The strip 55 of reinforcing material on the roll 54 has a second width $W_2$ less than the first width $W_1$.

The strip 55 of reinforcing material is pulled from the second roll 54 toward a pair of pressure rollers 56, 58. The puller forming material 42 and backing material 46 are redirected by guide rollers 50, 52, respectively, and pulled along converging pathways toward the pressure rollers 56, 58. The layers 42, 46 and the strip of reinforcing material 55 are pulled simultaneously toward the pressure rollers 56, 58. The layers 42, 46 and reinforcing material 55 are pulled between the pressure rollers 56, 58 to adhere the reinforcing material 55 to a center portion of the adhesive covered face of the puller forming material 42, and re-adhere the backing material 46 to the opposite edge portions of the face on opposite sides of the center portion.

The re-adhered layer 42 of puller forming material and the adhered reinforcing material 55 are die cut to form separate book pullers 10 extending widthwise across the backing material 46. Each puller 10 extends across the center portion to which the reinforcing material has been adhered and at least partially across each of the opposite edge portions to form the type of puller 10 shown in the drawings and described above. FIGS. 10 and 11 illustrate the currently preferred manner of carrying out the die cutting step. Downstream of the pressure rollers 56, 58, the strip of backing material 46 and the puller forming material 42 and reinforcing material 55 carried thereby are pulled through a pair of rollers 60, 62 including a die roller 60 and an anvil roller 62. FIG. 12 illustrates the cross section of the material being fed to the rollers 60, 62. Following the die cutting by the rollers 60, 62, the excess puller forming material 42 and reinforcing material 55 may be removed in a known manner. Preferably, the cut pullers 10 are retained on the backing material 46, and the material 46 is cut into strips 64, each of which has a plurality of pullers 10 releasably adhered thereto. The lengths of the pullers 10 can easily be varied simply by adjusting the widths of the rolls 40, 54 and the rollers 48, 50, 52, 56, 58, 60, 62.

Figure 6:
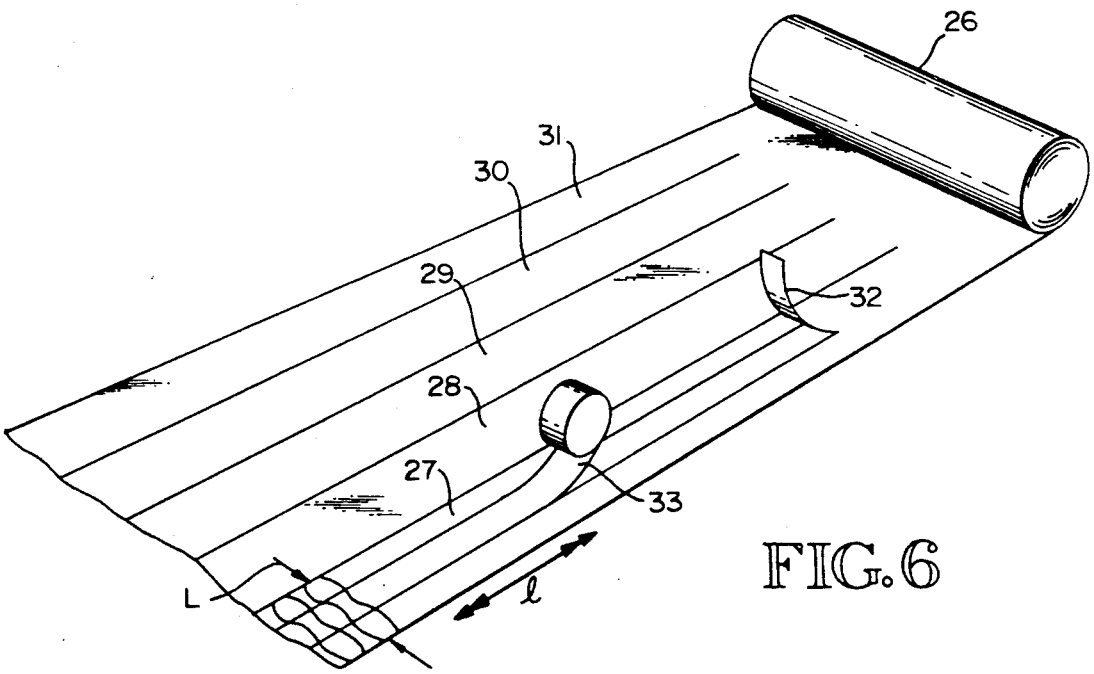
FIG. 6 is a schematic pictorial view illustrating a method of making the puller.

Another method of making the puller 10 in a range of lengths from the raw material as described is shown schematically in FIG. 6. It has been found to be within the capability of persons of ordinary skill in the art of designing and making paper and plastic film products to design and make apparatus required to make the pullers using the method depicted schematically in FIG. 6.

Referring to FIG. 6, the method of making the pullers comprises the steps of: (1) providing a roll 26 of Mylar (trademark) coated on one side only with pressure sensitive adhesive, that side being covered with a protective cover; (2) slitting the material into a plurality of strips 27, 28, 29, 30 and 31, of various widths, each width corresponding to a length of completed pullers, (NOTE: From this point on the method steps are described for one strip only but apply to all the strips, strip 27 being typical.); (3) removing the center portion of the protective cover 32 from each strip; (4) replacing the center portion with a strip 33 of plastic film and (5) die cutting pullers from each strip with the length L of the pullers transverse to the length l of the strip. The plastic film strip may be transparent or colored, translucent or opaque.

It is considered to be understandable from this description that the design of the subject puller enables achievement of the objectives of the invention. The puller is easily attached, particularly since proper placement of the end portions on the book is facilitated by the contour of the puller. Use of commercially available raw material rather than custom-made material provides a significant cost advantage. The well-known strength and tear resistance of Mylar ® allows for adequate strength with thin material which has minimal effects on storage space requirements. The puller is highly durable relative to its cost because the reinforcement of the center portion is made without sacrificing the strength of the puller at other points.

It is also considered to be understandable that while the preferred embodiments of the article and method of making it are described herein, other embodiments and modifications of the illustrated embodiments are possible within the scope of the invention which is limited only by the attached claims.

What is claimed is:

1. A book puller comprising a flexible planar main body having an elongated inner face coated with a pressure sensitive adhesive and a coextensive opposite outer face, said inner face having opposite end portions and a center portion extending between and connecting said end portions, said body having an essentially smooth continuous outer edge extending around and defining said end portions and said center portion, said outer edge having opposite sides, each of which includes a straight portion along each of said end portions and a concavely curved portion along said center portion joining said straight portions at respective junctures which are visually and tactilely perceptible; and a separate flexible planar reinforcing layer coextensive with and adhered to said center portion of said inner face; said center portion being dimensioned to form, when said end portions are adhered to front and back surfaces of a book, respectively, with said junctures positioned at opposite spine edges of the book, an arcuate handle extending around the book between said junctures and spaced from the book a distance sufficient to allow insertion of a finger between the book and said handle.

2. A method of manufacturing book pullers, comprising:

providing a roll of flexible sheet material including a layer of puller forming material having an inner face coated with a pressure sensitive adhesive and a layer of backing material releasably adhered to said face, said roll having a first width;

pulling said sheet material from said roll, separating said layers from each other by bending one of said layers around a roller, and pulling said layers separately along diverging pathways;

providing a second roll of flexible sheet material comprising a reinforcing material and having a second width less than said first width, and positioning said second roll between said layers downstream of said roller;

pulling said reinforcing material from said second roll toward a pair of pressure rollers, and simultaneously pulling said layers along converging pathways toward said pressure rollers;

pulling said layers and said reinforcing material between said pressure rollers to adhere said reinforcing material to a center portion of said face and re-adhere said backing material to opposite edge portions of said face on opposite sides of said center portion; and die cutting the re-adhered layer of puller forming material and said reinforcing material to form separate book pullers extending widthwise across said backing material, each said puller extending across said center portion and at least partially across each said edge portion.

3. A book puller made by the method of claim 2.

* * * * *